US009979102B2

(12) United States Patent
Zhao

(10) Patent No.: US 9,979,102 B2
(45) Date of Patent: May 22, 2018

(54) ELECTRICAL CONNECTOR ASSEMBLY

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/636,617

(22) Filed: Jun. 28, 2017

(65) Prior Publication Data

US 2017/0373409 A1 Dec. 28, 2017

(30) Foreign Application Priority Data

Jun. 28, 2016 (CN) ..... 2016 1 0482215

(51) Int. Cl.
*H01R 9/03* (2006.01)
*H01R 13/62* (2006.01)
*H01R 43/00* (2006.01)

(52) U.S. Cl.
CPC ..... *H01R 9/032* (2013.01); *H01R 13/62* (2013.01); *H01R 43/00* (2013.01)

(58) Field of Classification Search
CPC ..... H01R 9/032; H01R 13/62; H01R 43/00
See application file for complete search history.

(56) References Cited

U.S. PATENT DOCUMENTS

| | | | | |
|---|---|---|---|---|
| 9,478,905 | B2 | 10/2016 | Golko | |
| 9,640,885 | B2 | 5/2017 | Amini | |
| 9,847,606 | B2 * | 12/2017 | Xie | H01R 13/6585 |
| 2014/0024257 | A1 * | 1/2014 | Castillo | H01R 13/6585 439/607.05 |
| 2014/0194005 | A1 * | 7/2014 | Little | H01R 13/6585 439/607.28 |
| 2016/0020537 | A1 | 1/2016 | Ju | |

(Continued)

FOREIGN PATENT DOCUMENTS

| | | |
|---|---|---|
| CN | 201142397 | 10/2008 |
| CN | 104037548 | 9/2014 |
| CN | 204481257 U | 7/2015 |

(Continued)

*Primary Examiner* — Briggitte R Hammond
(74) *Attorney, Agent, or Firm* — Wei Te Chung; Ming Chieh Chang

(57) ABSTRACT

An electrical connector assembly includes a first electrical connector and a second electrical connector. The first electrical connector includes a first insulative housing having a receiving room, a number of conductive terminals affixed to the first insulative housing, and a metal shell enclosing the first insulative housing. The insulative housing defines a top wall and a bottom wall separated from the top wall. The conductive terminals are arranged in an upper row and a lower row. The second electrical connector includes a second insulative housing having a tongue portion extending forwardly and a number of mating terminals disposed on the tongue portion. The first electrical connector is located in an electrical device. The tongue portion of the second electrical connector is received in the receiving room of the first insulative housing. The tongue portion is sandwiched between the top wall and the bottom wall.

10 Claims, 9 Drawing Sheets

(56) References Cited

U.S. PATENT DOCUMENTS

| | | | | |
|---|---|---|---|---|
| 2016/0294101 | A1* | 10/2016 | Kao | H01R 13/502 |
| 2016/0380389 | A1* | 12/2016 | Ju | H01R 13/6585<br>439/607.05 |

FOREIGN PATENT DOCUMENTS

| | | |
|---|---|---|
| CN | 204885711 U | 12/2015 |
| TW | M500384 | 5/2015 |
| WO | WO2014042859 | 3/2014 |

* cited by examiner

ELECTRICAL CONNECTOR ASSEMBLY

BACKGROUND OF THE DISCLOSURE

1. Field of the Disclosure

The present disclosure relates to an electrical connector assembly, and more particularly to an electrical connector assembly adapted for normally and reversely mating.

2. Description of Related Arts

China Patent No. CN204885711 discloses a reversible or dual orientation USB Type-C connector mounted to an electrical device having an opening. The connector includes a mating hole, a first insulative housing, a number of conductive terminals affixed to the first insulative housing and a metal shell enclosing the first insulative housing. The mating hole communicates the opening of the electrical device. The first insulative housing includes a tongue portion protruding into the mating hole. Each conductive comprises a contacting portion disposed on the tongue portion and exposed to the mating hole. In prior arts the receptacle connector is located in the electrical device and the plug connector connects with a cable which occupies large size.

An improved electrical connector is desired.

SUMMARY OF THE DISCLOSURE

Accordingly, an object of the present disclosure is to provide an electrical connector assembly simple in construction, easy in process and smaller in size.

To achieve the above object, an electrical connector assembly includes a first electrical connector and a second electrical connector mated with the first electrical connector. The first electrical connector includes a first insulative housing having a receiving room, a number of conductive terminals affixed to the first insulative housing, and a metal shell enclosing the first insulative housing and the conductive terminals. The insulative housing defines a top wall and a bottom wall separated from the top wall. The conductive terminals are arranged in an upper row and a lower row. The second electrical connector includes a second insulative housing having a tongue portion extending forwardly and a number of mating terminals disposed on the tongue portion. The first electrical connector is located in an electrical device. The tongue portion of the second electrical connector is received in the receiving room of the first insulative housing of the first electrical connector. The tongue portion is sandwiched between the top wall and the bottom wall.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure. Referring to FIGS. 1 to 7, an electrical connector assembly includes a first/host electrical connector 100 and a second/plug/cable electrical connector 200 adapted for normally and reversely mating. The first electrical connector 100 is located in an electrical device 300. The electrical connector assembly defines a mating direction, a transverse direction perpendicular to the mating direction and a vertical direction perpendicular to the mating direction and the transverse direction. The mating direction and the transverse direction define a horizontal plane.

Figure 7:
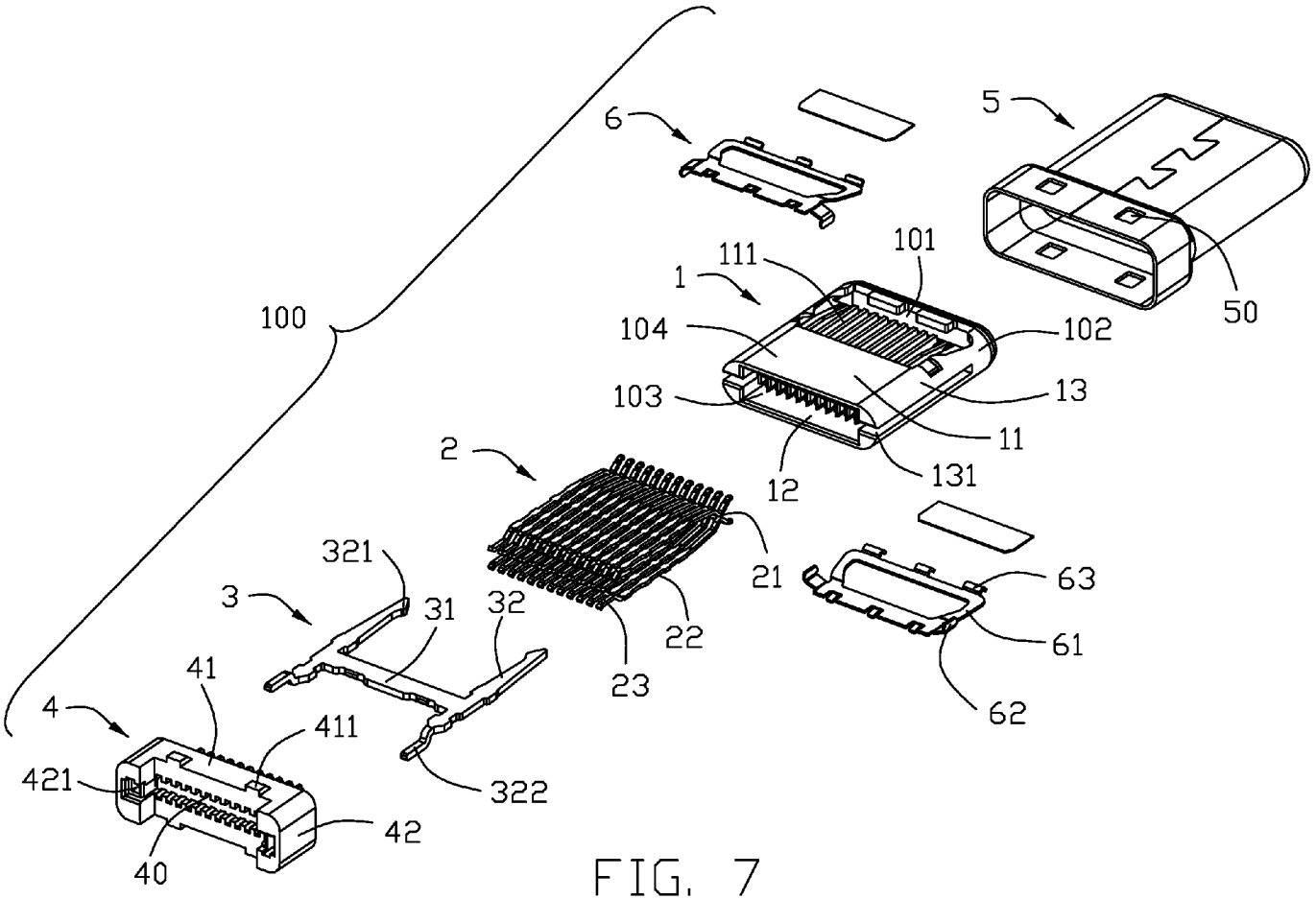
FIG. 7 is an exploded view of the first electrical connector of the electrical connector assembly.

Referring to FIG. 7, the first electrical connector 100 includes a first insulative housing 1, a number of conductive terminals 2 affixed to the first insulative housing 1 and arranged in two rows in the vertical direction, a latch 3 sandwiched between two rows of the conductive terminals 2 and locking with the second electrical connector 200, a insulative member 4 located at a rear end of the first insulative housing 1, a metal shell 5 enclosing the insulative housing 1 and the insulative member 4, and a pair of shielding plates 6 affixed to the insulative housing 1.

The first insulative housing 1 includes a top wall 11, a bottom wall 12 opposite to the top wall 11, and a pair of lateral walls 13 connecting the top wall 11 and the bottom wall 12 for forming a receiving room 10. The first insulative housing 1 further includes a front portion 102 and a rear portion 104 dividing the receiving room into two parts. The front portion 102 includes a front opening 101. The rear portion 104 includes a rear opening 103. The top wall 11 and the bottom wall 12 include a number of first grooves 111 located at a front end thereof and communicating with the front portion 102 of the receiving room 10. Each lateral wall 13 includes a second groove 131 extending forwardly from a rear end of the insulative housing 1.

The conductive terminals 2 are symmetrically distributed along the central axis extending in the mating direction and arranged in an upper row and a lower row. The number of each row of conductive terminals is twelve. Each conductive terminal 2 includes a contacting portion 21 extending into the front portion 102, a tail 23 extending outwardly from the first insulative housing 1, and a fixed portion 22 connecting the contacting portion 21 and the tail 23. The contacting portion 21 connects the second electrical connector 200 conductively. Each contacting portion 21 of the conductive terminals 2 in the upper row is positioned in reverse symmetry with respect to a respective one of the conductive terminals 2 in the lower row.

The latch 3 includes a connecting arm 31 extending in the transverse direction and a pair of locking arms 32 extending in the mating direction from two sides of the connecting arm 31. The latch 3 is received in the insulative housing 1 along a rear-to-front direction through the rear opening 103. The locking arms 32 are received in the second grooves 131 respectively. The locking arms 32 include a pair of protrusions 321 located at a front end and protruding inward and a pair of clapping portions 322 located at a rear end thereof. The protrusions 321 partially extend into the front portion 102. One of the clapping portions 322 extends upwardly to be higher than the connecting arm 31 while the other extends downwardly to be lower than the connecting arm 31 making a good effect of clapping in the vertical direction.

The insulative member 4 together with the first insulative housing 1 locks the latch 3. The insulative member 4 includes a base portion 41, a pair of extending portions 42 extending rearward from two sides of the base portion 41, two rows of through holes 40 located in the vertical direction and communicating the base portion 41, and a number of convexes 43 extending in the mating direction. The insulative member 4 further includes a number of terminal slots 44 located between the abutting convexes 43 and communicating the through holes 40, a pair of mounting grooves 421 located in the extending portions 42 in the mating direction and a receiving slot 45 formed between the upper row of the convexes 43 and the lower row of the convexes 43. The size of the base portion 41 in the vertical direction is larger than that of the first insulative housing 1 making the insulative member 4 assembled to a rear end of the insulative housing 1. The base portion 41 protrudes outwardly from the top wall 11 and the bottom wall 12. The insulative member 4 is assembled to the first insulative housing 1 along the rear-to-front direction making the connecting arm 31 of the latch 3 received in the receiving slot 45. The tails 23 penetrate the base portion 41 through the terminals slots 44 and through holes 40. The base portion 41 includes a number of tubers 411 located at an upper surface and a lower surface thereof.

The metal shell 5 is a closed structure making the sealing property and the anti-electromagnetic interference ability good. The closed structure of the metal shell 5 can be formed by pumping process of metal pieces, bending process of metal strings or casting process of metal materials and so on. The metal shell 5 includes a number of positioning openings 50 located at an upper surface and a lower surface of a rear end thereof. The positioning openings 50 receive the tubers 411 making the insulative member 4 fixed to the metal shell 5.

The pair of shielding plates 6 are received in the top wall 11 and the bottom wall 12 along the vertical direction. Each shielding plate 6 includes a main portion 61, a pair of mounting portions 62 extending outwardly from the main portion 61 and assembled to the first insulative housing 1, and three grounding arms 63 extending forwardly into the receiving room 10 from the main portion 61. The grounding arms 63 penetrate the first grooves 111 and are mated with the second electrical connector 200. The grounding arms 63 of the pair of the shielding plates 6 are allocated in two rows in the vertical direction. The distance between the upper grounding arms 63 and the corresponded lower grounding arms 63 is large than that of the contacting portions 21.

The first electrical connector 100 is a plug connector meeting USB Type C specification. Referring to FIGS. 1 to 4, the first electrical connector 100 is received in the electrical device 300. A sealer 400 is attached to a front end of the first electrical connector 100. The electrical device 300 includes a mounting hole 301 penetrating inward and outwardly. The sealer 400 includes a cylindrical portion 401 and a resisting portion 402 located at the cylindrical portion 401 and formed at the vertical direction. The cylindrical portion 401 penetrates forwardly and rearward and includes a mating hole 403 in the mating direction. The resisting portion 402 surrounds the cylindrical portion 401 and divides the cylindrical direction into two parts in the mating direction. The cylindrical portion 401 located in front of the resisting portion 402 is received in the mounting hole 301. The front surface of the sealer 400 is substantially flush with the outer surface of the electrical device 300. The resisting portion 402 resists against with an inner surface of the electrical device 300. The sealer 400 is attached to the metal shell 5 making a front opening of the metal shell 5 resisting against with the cylindrical direction located in a rear end of the resisting portion 402. The electrical device 300 is a mobile-phone and a pad.

Figure 1:
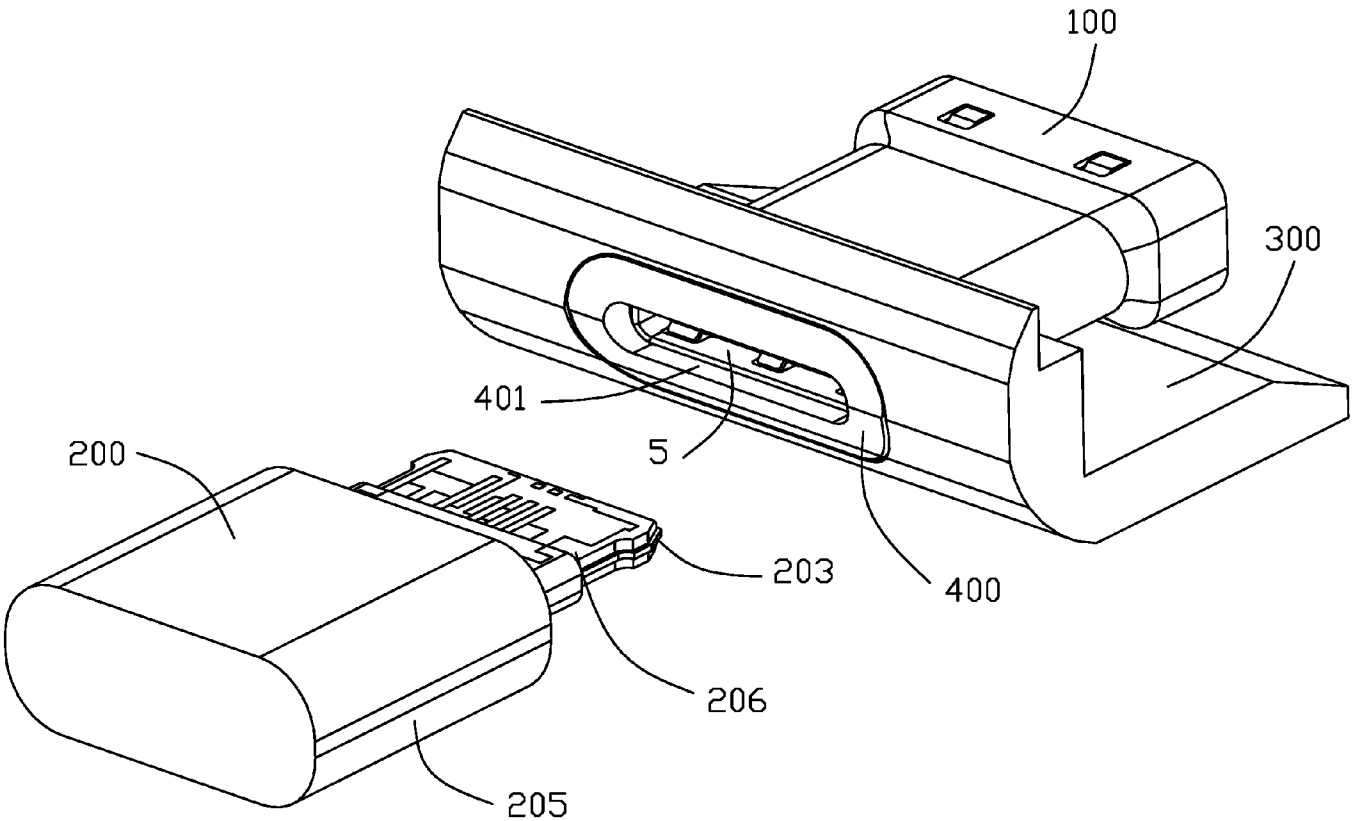
FIG. 1 is a perspective, assembled view of a first electrical connector separated from a second electrical connector in an electrical device of an electrical connector assembly.
Figure 2:
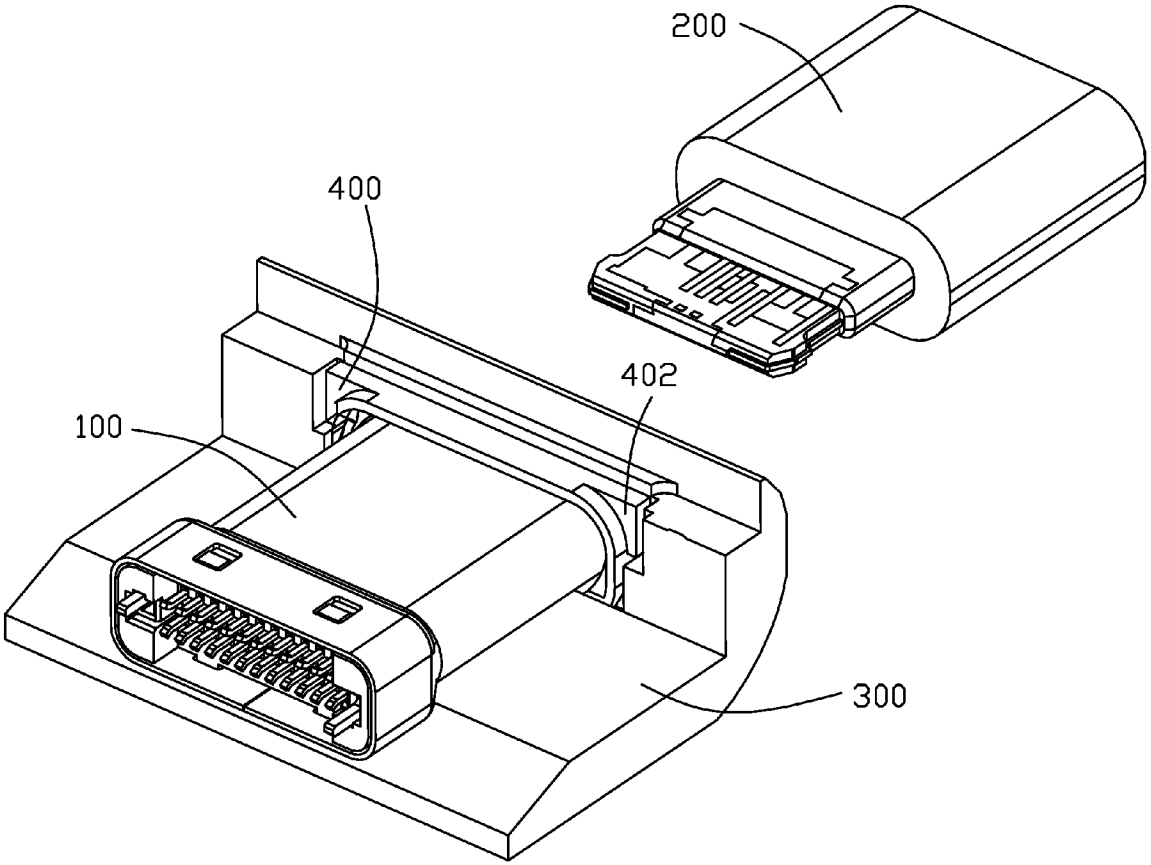
FIG. 2 is another perspective, assembled view of the electrical connector assembly taken from FIG. 1.
Figure 3:
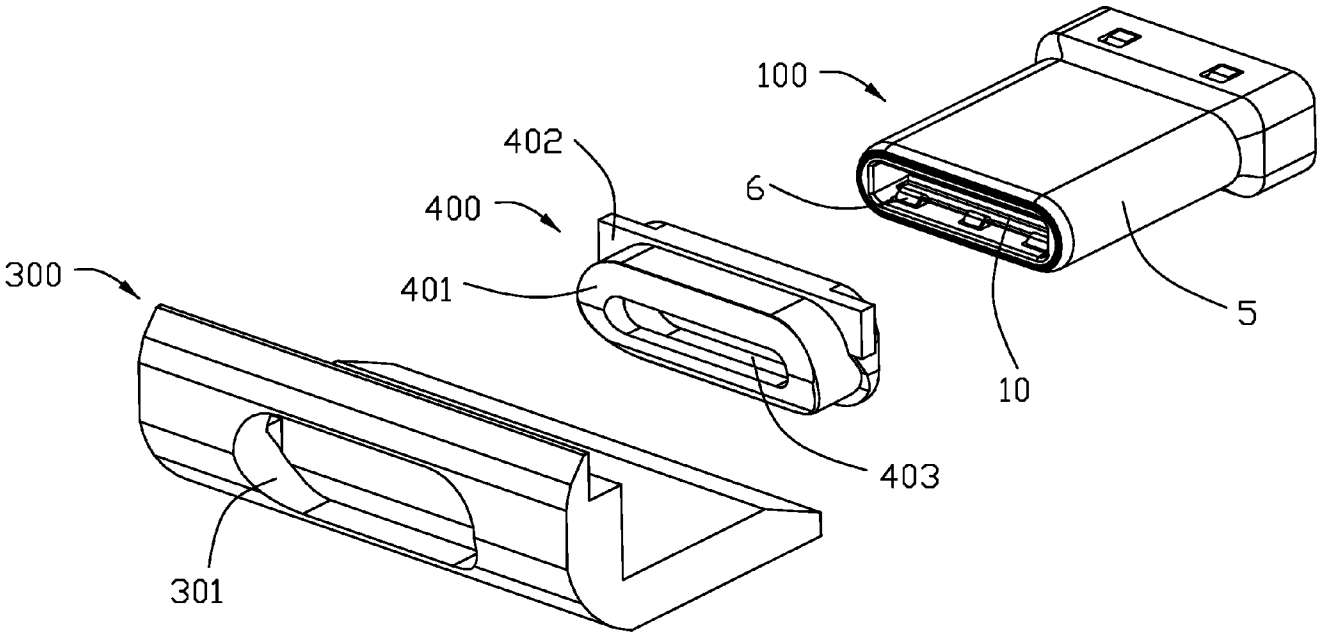
FIG. 3 is a perspective, assembled view of the first electrical connector separated from the electrical device and a sealer.
Figure 4:
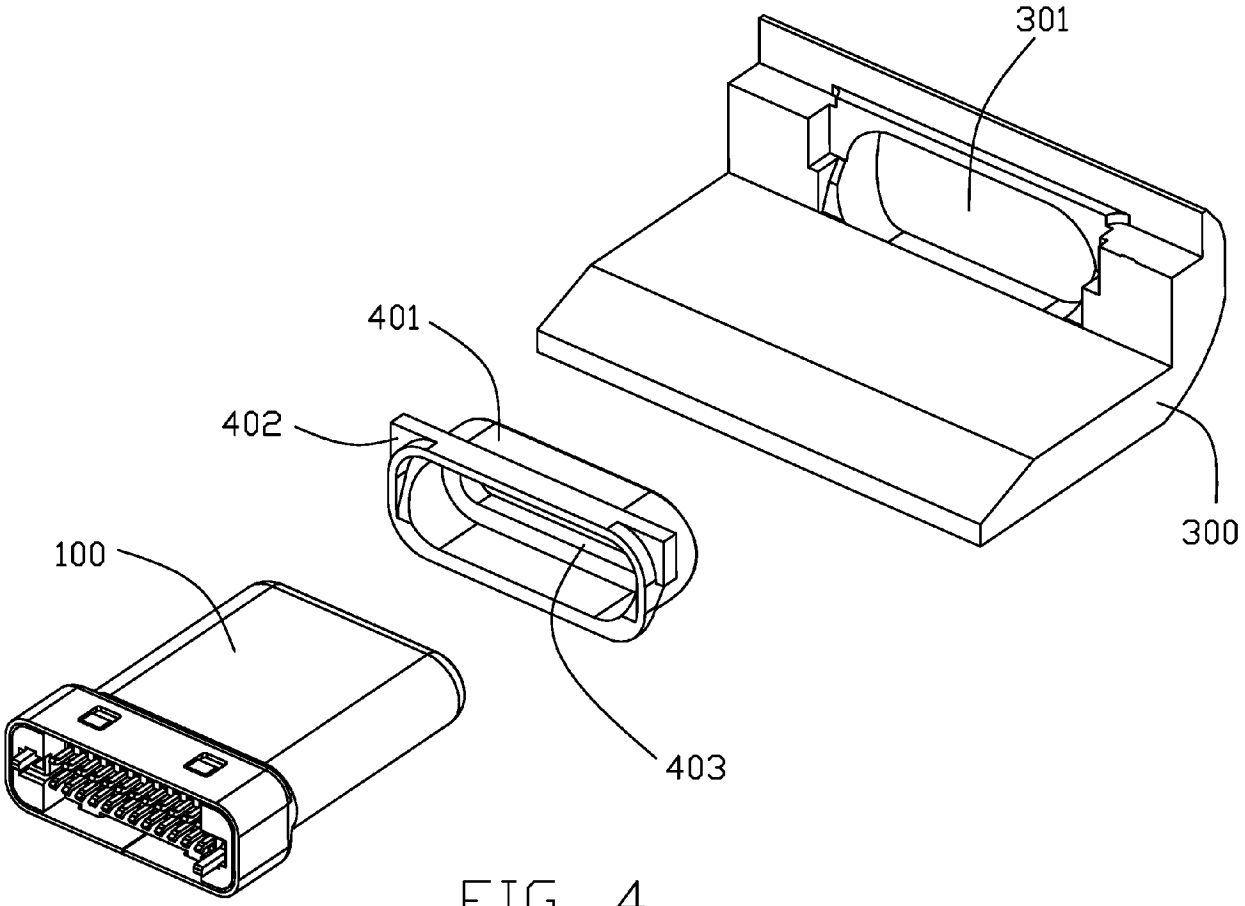
FIG. 4 is another perspective, assembled view of the first electrical connector taken from FIG. 3.
Figure 5:
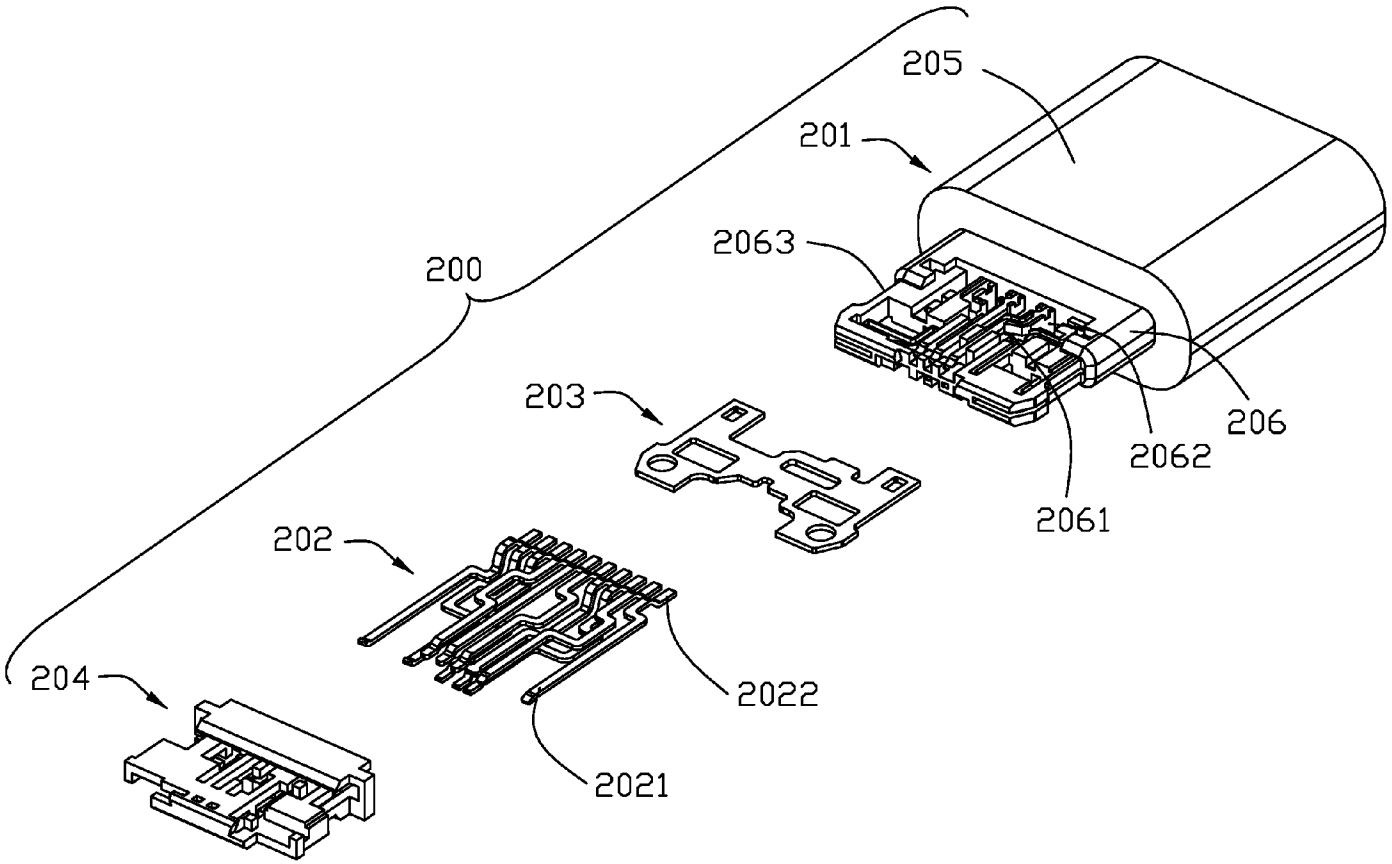
FIG. 5 is an exploded view of the second electrical connector of the electrical connector assembly.
Figure 6:
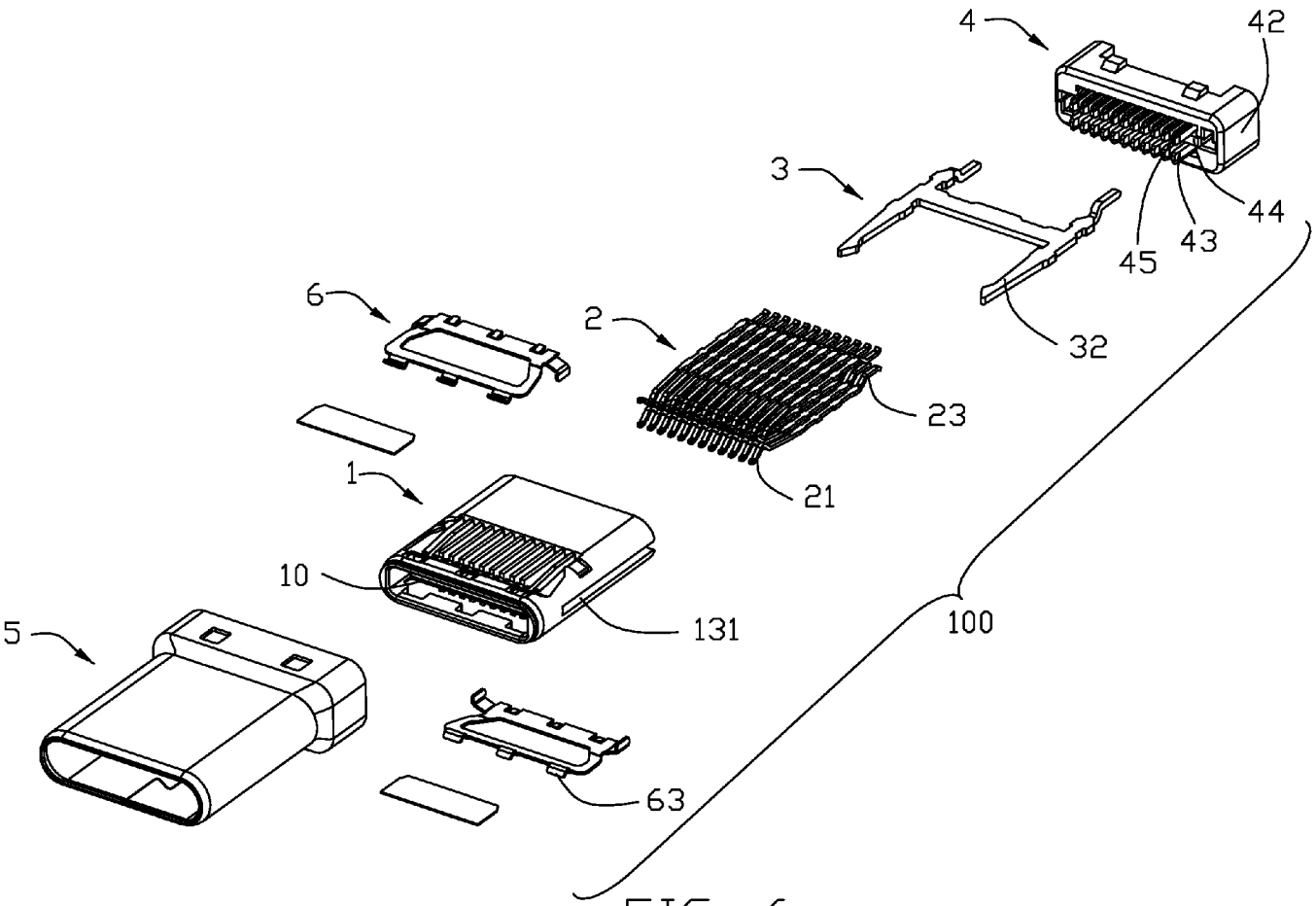
FIG. 6 is another exploded view of the second electrical connector taken from FIG. 5.

Referring to FIGS. 5 to 6, the second electrical connector 200 is a receptacle connector. The second electrical connector 200 includes a second insulative housing 201, a number of mating terminals 202 affixed to the second insulative housing 201, a metallic shielding/grounding/latching/reinforcing piece 203 assembled to the second insulative housing 201, and an insulator 204 integrated with the second insulative housing 201. The second insulative housing 201 includes a base section 205 and a tongue portion 206 extending forwardly from the base section 205. The tongue portion 206 includes an upper surface and a lower surface and each including a number of terminal grooves 2061 and a number of penetrating holes 2062 for inserting of mold. The tongue portion 206 further includes a pair of locking grooves 2063 located laterally mated with the latch 3.

Each mating terminal 202 includes a conductive portion 2021 exposed to the upper surface and a lower surface of the tongue portion 206, and a soldering portion 2022 extending rearward from the second insulative housing 201. The mating terminals 202 are disposed in two rows and each row of mating terminals 202 are positioned in reverse symmetry to each other. The soldering portions 2022 of the two rows of the mating terminals 202 are allocated in a row. The arrangement of the mating terminals 202 makes the conductive portions 2021 connect with the corresponded contacting portions 21.

The reinforcing piece 203 is received in the tongue portion 206. The reinforcing piece 203 is insert molding with the second insulative housing 201. Two sides of a front end of the reinforcing piece 203 are exposed to the second insulative housing 201.

The insulator 204 is integrated with the second insulative housing 201 and seals the penetrating holes 2062 filling the second insulative housing 201.

The tongue portion 206 of the second electrical connector 200 inserts into the mounting hole 301 of the electrical device 300 and is received in the receiving room 10 when the first electrical connector 100 is mated with the second electrical connector 200. The tongue portion 206 of the second electrical connector 200 is sandwiched between the top wall 11 and the bottom wall 12 of the first electrical connector.

Figure 8:
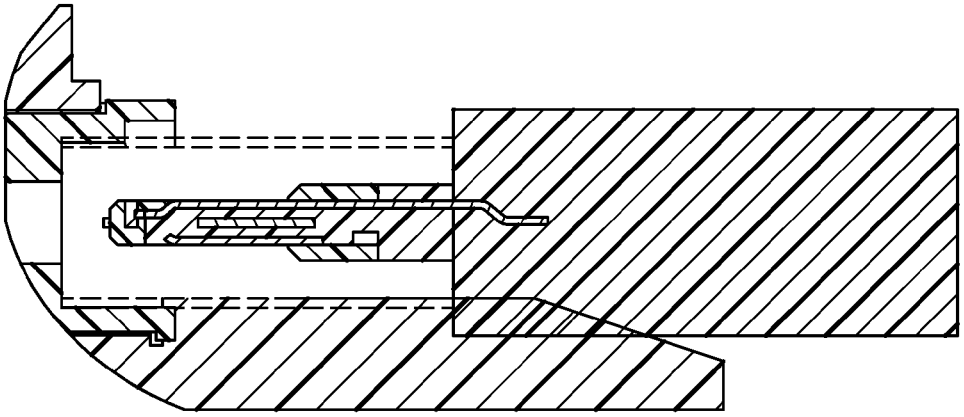
FIG. 8 is a cross-sectional view of the hypothetical electrical connector assembly.
Figure 9:
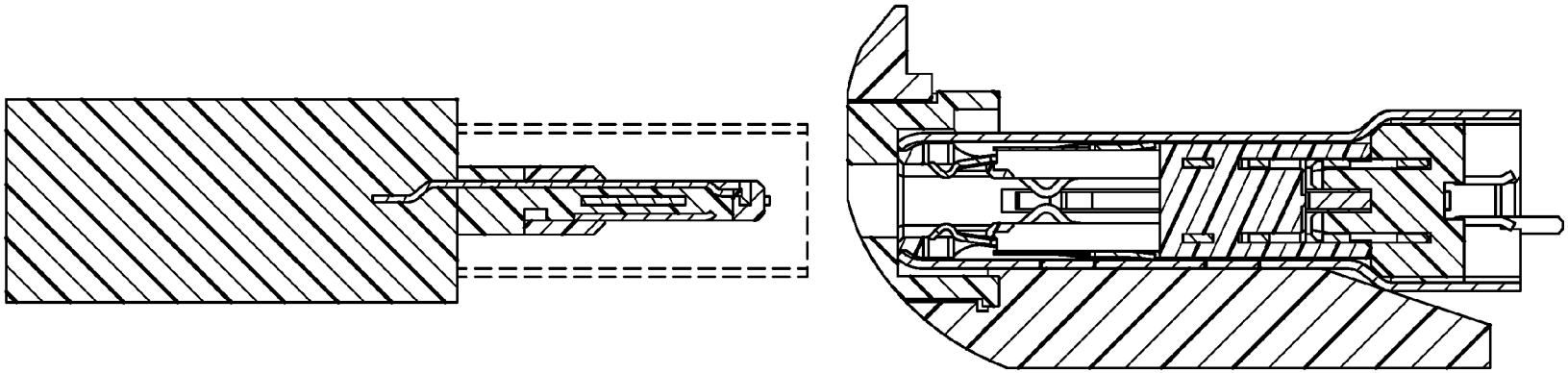
FIG. 9 is another cross-sectional view of another hypothetical electrical connector assembly

The spirit of the invention is to provide an opposite arrangement of the traditional Type C connector with some modification to allow the modified Type C connector assembly used within the thinner cellular phone wherein the mating opening in the chassis of the electrical device 300 is not positioned at the middle level of the electrical device 300 in the thickness direction. Therefore, the outer metallic shielding shell of the receptacle connector may be no longer desired to surround the corresponding metallic shell of the cable/plug connector inserted into the opening of the chassis of the electrical device 300. On one hand, FIG. 8 shows a hypothetical/traditional receptacle connector having the outer metallic shell in the dashed lines, disposed in the relatively thinner electrical device 300, which may somewhat interfere with the existing structures of the chassis. On the other hand, FIG. 9 shows another hypothetical connector which directly the traditional cable/plug connector with the traditional receptacle connector at a front region of the cable (not shown). Understandably, the outer metallic shell shown in the dashed lines also may interfere with the chassis of the thinner electrical device 300. Understandably, because there is the metallic reinforcing piece 203 embedded within the tongue portion 206, and the tongue portion 206 forms a thicker portion around the root adjacent to the base section 205, and the reinforcing piece 203 may be made via a die-casting or forging way with different/thicker dimension around the periphery rather than stamping from sheet metal, there is no concern regarding the possibility of breakage of the tongue portion 206 during using, compare with the traditional design on some other type connector assembly in which the mating connector uses the single minor tongue portion lacking such reinforcing piece for mating. In other words, the instant invention is workable in practice.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a first electrical connector comprising:

a first insulative housing having a receiving room, a top wall, and a bottom wall separated from the top wall;

a plurality of conductive terminals affixed to the first insulative housing and arranged in an upper row and a lower row; and a metal shell enclosing the first insulative housing and the conductive terminals; and a second electrical connector mated with the first electrical connector and comprising:

a second insulative housing having a tongue portion extending forwardly; and a plurality of mating terminals disposed on the tongue portion;

wherein the first electrical connector is located in an electrical device, the tongue portion of the second electrical connector is received in the receiving room of the first insulative housing of the first electrical connector, and the tongue portion is sandwiched between the top wall and the bottom wall.

2. The electrical connector assembly as claimed in claim 1, wherein the conductive terminals arranged in the upper row of the first electrical connector is positioned in reverse symmetry with respect to a respective one of the conductive terminals arranged in the lower row, and the mating terminals are connected with the conductive terminals conductively.

3. The electrical connector assembly as claimed in claim 1, wherein the second electrical connector comprises a base section located at a rear end of the tongue portion and connecting with a cable.

4. The electrical connector assembly as claimed in claim 1, wherein the first electrical connector comprises a latch affixed to the first insulative housing, and the tongue portion comprises a pair of locking grooves located laterally and engaged with the latch.

5. The electrical connector assembly as claimed in claim 3, wherein the tongue portion is totally exposed outside to the base section, the tongue portion comprises a reinforcing piece, and two sides of a front end of the reinforcing piece are exposed to the tongue portion.

6. The electrical connector assembly as claimed in claim 1, wherein the first electrical connector comprises a pair of lateral walls connecting the top wall and the bottom wall, the top wall and the bottom wall for forming the receiving room shown a cylindrical shape.

7. The electrical connector assembly as claimed in claim 1, wherein the first electrical connector comprises a sealer located at a front end thereof and sealing a gap between the first electrical connector and the electrical device.

8. The electrical connector assembly as claimed in claim 1, wherein the mating terminals are disposed in two rows, each row of mating terminals are positioned in reverse symmetry to each other, and the mating terminals are located at an upper surface and a lower surface of the tongue portion.

9. The electrical connector assembly as claimed in claim 1, wherein the electrical device is a mobile-phone and a pad, and the tongue portion is exposed outside.

10. The electrical connector assembly as claimed in claim 1, wherein each conductive terminal comprises a tail extending outwardly from the first insulative housing, and the tails arranged in two rows form a space receiving a printed circuit board.

* * * * *